US011240891B2

(12) United States Patent
Luo

(10) Patent No.: US 11,240,891 B2
(45) Date of Patent: Feb. 1, 2022

(54) CONSTANT-CURRENT AND CONSTANT-VOLTAGE CONNECTION METHOD FOR LED LAMPS AND DIMMABLE LOW-LOSS LED LAMP

(71) Applicant: Wuning Luo, Guangxi (CN)

(72) Inventor: Wuning Luo, Guangxi (CN)

( * ) Notice: Subject to any disclaimer, the term of this patent is extended or adjusted under 35 U.S.C. 154(b) by 0 days.

(21) Appl. No.: 17/164,565

(22) Filed: Feb. 1, 2021

(65) Prior Publication Data

US 2021/0160984 A1 May 27, 2021

Related U.S. Application Data

(63) Continuation of application No. PCT/CN2019/097147, filed on Jul. 22, 2019.

(30) Foreign Application Priority Data

Aug. 2, 2018 (CN) ..... 201810871570.6
Aug. 2, 2018 (CN) ..... 201821239337.8

(51) Int. Cl.
*H05B 45/345* (2020.01)
*H05B 45/34* (2020.01)
*H05B 45/10* (2020.01)

(52) U.S. Cl.
CPC ..... *H05B 45/345* (2020.01); *H05B 45/10* (2020.01); *H05B 45/34* (2020.01)

(58) Field of Classification Search
None
See application file for complete search history.

(56) References Cited

U.S. PATENT DOCUMENTS

2017/0321872 A1* 11/2017 Lin ..... F21V 23/02

FOREIGN PATENT DOCUMENTS

| | | | |
|---|---|---|---|
| CN | 203027542 U | | 6/2013 |
| CN | 103796375 A | | 5/2014 |
| CN | 106979467 A | | 7/2017 |
| CN | 207235161 U | | 4/2018 |
| CN | 108777902 A | | 11/2018 |
| CN | 208434150 U | | 1/2019 |
| CN | 210515969 U | * | 5/2020 |

* cited by examiner

*Primary Examiner* — Jany Richardson

(57) ABSTRACT

Disclosed is a constant-current and constant-voltage connection method for LED lamps and a dimmable low-loss LED lamp. A plurality of LED lamps are connected in parallel at both ends of an external constant-current switching power supply, and a total distance of a connection circuit of each LED lamp from a positive electrode of the external constant-current switching power supply to a positive electrode of the LED lamp to a negative electrode and then back to a negative electrode of the external constant-current switching power supply is the same. In each LED lamp, a plurality of LED bead units are connected in parallel, and each LED bead unit is composed of a plurality of LED beads connected in series. Each LED lamp, each LED bead unit and each LED bead have the same voltage. The dimming of the LED lamp can be controlled by regulating the output current.

4 Claims, 3 Drawing Sheets

CONSTANT-CURRENT AND CONSTANT-VOLTAGE CONNECTION METHOD FOR LED LAMPS AND DIMMABLE LOW-LOSS LED LAMP

CROSS-REFERENCE TO RELATED APPLICATIONS

This application is a continuation of International Patent Application No. PCT/CN2019/097147, filed on Jul. 22, 2019, which claims the benefit of priority from Chinese Patent Application No. 201810871570.6, filed on Aug. 2, 2018 and No. 201821239337.8, filed on Aug. 2, 2018. The content of the aforementioned applications, including any intervening amendments thereto, is incorporated herein by reference in its entirety.

TECHNICAL FIELD

The present invention belongs to the technical field of LED lamps, and particularly relates to a constant-current and constant-voltage connection method for LED lamps and a dimmable low-loss LED lamp.

BACKGROUND OF THE PRESENT INVENTION

Because of characteristics such as good illumination effect, fast response, low energy consumption, low light attenuation, no ultraviolet ray and no infrared radiation, LED lamps have been widely used in landscape gardens, schools, hospitals, hotels, conference rooms, exhibition halls, display cabinets, factories, offices, supermarkets and other places. The LED lamp has great advantages whether in substituting the existing traditional fluorescent lamps or adding new LED lamps.

The traditional LED lamp is generally driven by constant current so as to prolong the service life and improve the light attenuation of the LED. For example, for garden landscape lighting lamps, exterior door lighting lamps, bridge LED guardrail fluorescent tubes and LED wall washer that are commonly used at present, a conventional solution is as follows: as shown in FIG. 1, the LED wall washer uses a 24 W LED tube with four LED bead units connected in parallel inside, and each LED bead unit is formed by serially connecting a built-in constant-current power supply chip M and six LED beads. The exterior power supply is supplied by a 24V constant-voltage switching power supply. A working voltage of each LED bead is 3V. The constant-current power supply chip M such as a common LM317 has a voltage drop of 6V and current of 250 mA, such that the constant-current power supply chip M has power consumption of 1.5 W. The total power consumption of the constant-current power supply chips M of the four LED bead units is 6 W, accounting for 25% of the total power consumption of the 24 W tube.

At present, in a lot of application fields of the LED lamp, a plurality of LED lamps are powered by one constant-voltage switching current, and a plurality of LED lamps are distributed as required. For example, twelve 24 W LED tubes are used to form a lighting strip, and an installation method is as shown in FIG. 2. A positive wire and a negative wire are drawn out respectively from a positive electrode and a negative electrode of a 24V constant-voltage switching power supply, and positive ends and negative ends of the twelve 24 W LED tubes are correspondingly connected respectively with the positive wire and the negative wire.

When in practical application, it is not difficult to find out that a total distance of a circuit from the positive electrode of the 24V constant-voltage switching power supply to the positive end of the LED tube to the negative end and then back to the negative electrode of the 24V constant-voltage switching power supply is not all the same. Because of different circuit loss, the twelfth LED tube on the furthest end only has the voltage of 22V. If there is no built-in constant-current power supply chip M, each LED tube is different in voltage and different in brightness. Therefore, in order to guarantee the brightness uniformity, the constant-current power supply chip M must be embedded. Due to the presence of the constant-current power supply chip M, the voltage of each LED bead unit is basically the same. In order to guarantee the same current of the LED bead units, the cost is to increase the lamp loss.

SUMMARY OF THE PRESENT INVENTION

In order to solve the above technical problems, the present invention provides a constant-current and constant-voltage connection method for LED lamps and a dimmable low-loss LED lamp, so that a built-in constant-current power supply chip can be saved, loss can be reduced, the dimming of the LED lamp can be realized, each LED bead in the LED lamp has the same voltage and uniform brightness, a plurality of LED lamps that are connected in parallel are powered by one external constant-current switching power supply, and each LED lamp is ensured to have the same voltage and uniform brightness.

To solve the above technical problems, the present invention adopts the following technical solutions:

A constant-current and constant-voltage connection method for LED lamps is provided. A plurality of LED lamps are connected in parallel at both ends of an external constant-current switching power supply, and a total distance of a connection circuit of each LED lamp from a positive electrode of the external constant-current switching power supply to a positive electrode of the LED lamp to a negative electrode and then back to a negative electrode of the external constant-current switching power supply is the same.

In each LED lamp, a plurality of LED bead units are connected in parallel, and each LED bead unit is composed of a plurality of LED beads that are connected in series; a plurality of LED bead units are connected in parallel, so that a total distance of the connection circuit of each LED bead unit from the positive electrode of the LED lamp to a positive end of the LED bead unit to a negative end of the LED bead unit and then back to the negative electrode of the LED lamp is the same.

The external constant-current switching power supply is connected with a controller through an RS485 bus or an RS232 bus or a CAN bus.

A dimmable low-loss LED lamp is provided. In each LED lamp, a plurality of LED bead units are connected in parallel, and each LED bead unit is composed of a plurality of LED beads that are connected in series; and the LED lamp is connected with an external constant-current switching power supply, and the external constant-current switching power supply is connected with a controller. A total distance of a connection circuit of each LED bead unit from a positive electrode of the external constant-current switching power supply to a positive electrode of the LED lamp to a positive end of the LED bead unit to a negative end of the LED bead unit to a negative electrode of the LED lamp and then back to a negative electrode of the external constant-current switching power supply is the same.

The present invention has the advantages that compared with the prior art, the LED lamp of the present invention does not use the built-in constant-current chip, thereby reducing additional loss, and meeting the energy-saving and environment protecting requirement. In the LED lamp of the present invention, voltages of each LED bead unit and each LED bead are consistent, thereby guaranteeing the brightness uniformity. By using the external constant-current switching power supply to substitute the original constant-voltage switching power supply, the dimming of the LED lamp can be controlled by regulating the output current of the external constant-current switching power supply through the controller. By using the constant-current and constant-voltage connection method of the present invention, a plurality of LED lamps that are connected in parallel can be powered by only one external constant-current switching power supply, and each LED lamp is ensured to have the same voltage and uniform brightness.

BRIEF DESCRIPTION OF THE DRAWINGS

In FIG. 3, 1: tube; 2: LED bead unit.

In FIG. 5, 1: tube; 2: LED bead unit.

DETAILED DESCRIPTION OF THE PRESENT INVENTION

Specific embodiments of the present invention are described below in detail in combination with the accompanying drawings, but do not constitute limitations to the protection scope of claims of the present invention.

Embodiment 1

Figure 1:
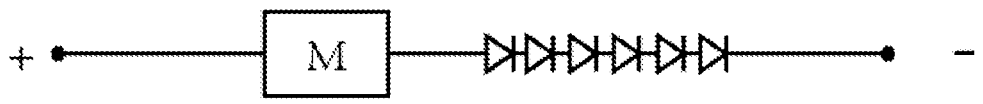
FIG. 1 is a structural schematic diagram of an LED bead unit in a 24 W LED tube in the prior art.
Figure 2:
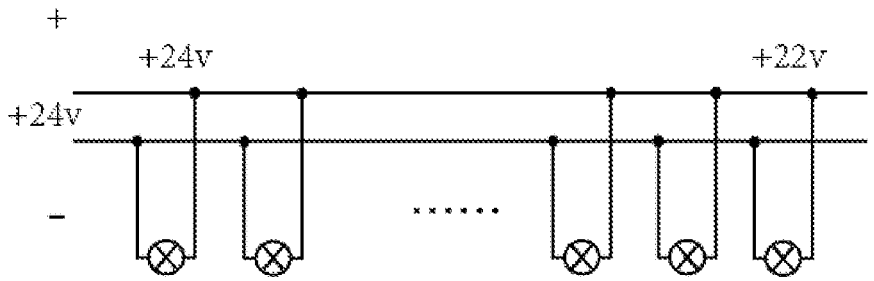
FIG. 2 shows an installation method of a lighting strip produced by a plurality of LED lamps in the prior art.
Figure 3:
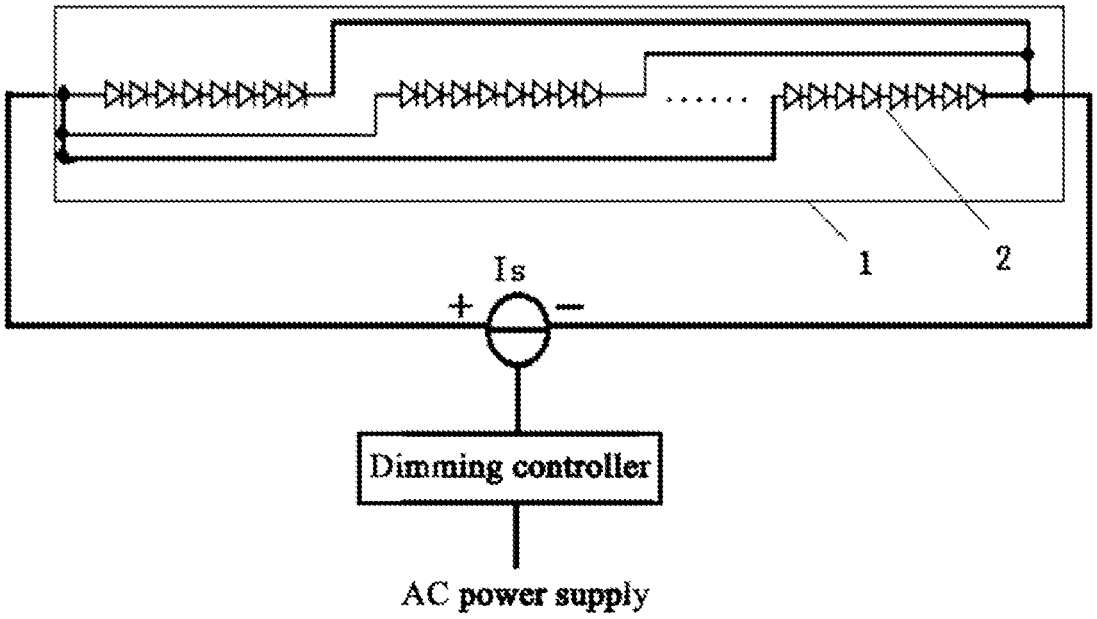
FIG. 3 is a structural schematic diagram of an LED tube according to embodiment 1 of the present invention.

As shown in FIG. 3, a dimmable low-loss LED lamp is in a tube shape. The LED lamp has power of 24 W and is powered by a 24V external constant-current switching power supply Is. Four LED bead units 2 are connected in parallel in a tube 1. Each LED bead unit 2 has power of 6 W. Each LED bead unit 2 is composed of eight 3V LED beads that are connected in series. No built-in constant-current chip is needed. A dimming controller is connected with the external constant-current switching power supply Is to regulate an output current of the external constant-current switching power supply Is, thereby controlling the dimming of the LED lamp. The dimming controller of the present embodiment adopts a commercially available LEDICD intelligent dimming apparatus, and the external constant-current switching power supply adopts the commercially available FND200 W1C.

Four LED bead units in the LED tube 1 are distributed in order. A positive terminal and a negative terminal of the LED tube 1 are arranged respectively at both ends of the LED tube, and a positive electrode and a negative electrode of the external constant-current switching power supply Is are correspondingly connected respectively with the positive terminal and negative terminal of the LED tube 1. A positive end of each LED bead unit 2 is connected respectively to the positive terminal of the LED tube 1 through an independent electric wire. A negative end of each LED bead unit 2 is connected respectively to the negative terminal of the LED tube 1 through an independent electric wire.

Figure 4:
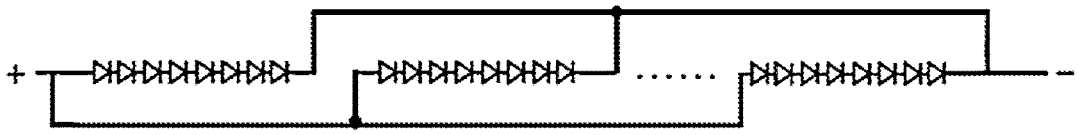
FIG. 4 is a structural schematic diagram of another connection way of a plurality of LED bead units in the LED tube according to embodiment 1 of the present invention.

Connection inside the LED tube may also be as shown in FIG. 4. A common positive power wire extending out from the positive terminal of the LED tube passes through the four LED bead units in order, and a common negative power wire extending out from the negative terminal of the LED tube passes through the four LED bead units in a reverse order. The positive end of each LED bead unit is connected to the common positive power wire. The negative end of each LED bead unit is connected to the common negative power wire.

After wiring as shown in FIG. 3 or FIG. 4, for each LED bead unit, a total distance of a circuit from the positive electrode of the external constant-current switching power supply Is to the positive terminal of the LED tube to the positive end of the LED bead unit to the negative end to the negative terminal of the LED tube and then back to the negative electrode of the external constant-current switching power supply Is is the same. Thus, voltages at two ends of each LED bead unit are the same and are both 24 V, so that each LED bead unit is ensured to have uniform brightness.

Embodiment 2

Figure 5:
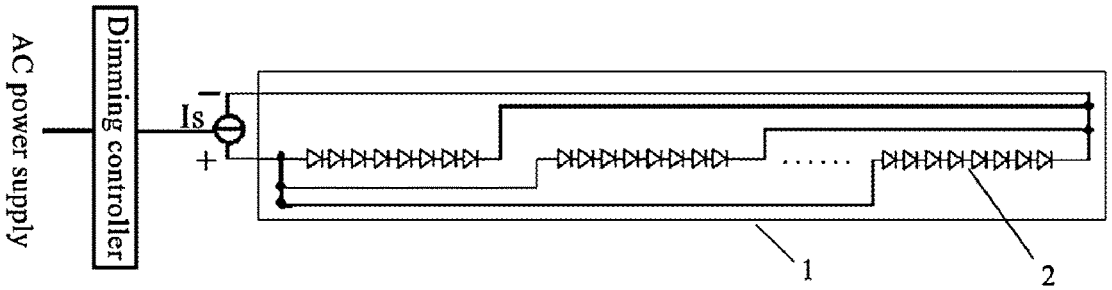
FIG. 5 is a structural schematic diagram of an LED tube according to embodiment 2 of the present invention.

As shown in FIG. 5, a dimmable low-loss LED lamp is in a tube shape. The LED lamp has power of 24 W and is powered by a 24V external constant-current switching power supply Is. Four LED bead units 2 are connected in parallel in a tube 1. Each LED bead unit 2 has power of 6 W. Each LED bead unit 2 is composed of eight 3V LED beads that are connected in series. No built-in constant-current chip is needed. A dimming controller is connected with the external constant-current switching power supply Is to regulate an output current of the external constant-current switching power supply Is, thereby controlling the dimming of the LED lamp.

Four LED bead units 2 in the LED tube 1 are distributed in order. A positive terminal and a negative terminal of the LED tube 1 are arranged respectively at the same end of the LED tube 1, and a positive electrode and a negative electrode of the external constant-current switching power supply Is are correspondingly connected respectively with the positive terminal and negative terminal of the LED tube 1. A positive end of each LED bead unit 2 is connected to the positive terminal of the LED tube 1 through an independent electric wire. A negative end of each LED bead 2 is connected to the negative end of the last LED bead unit 2 through an independent electric wire, and the negative end of the last LED bead unit 2 is connected to the negative terminal of the LED tube 1 through an independent electric wire.

Figure 6:
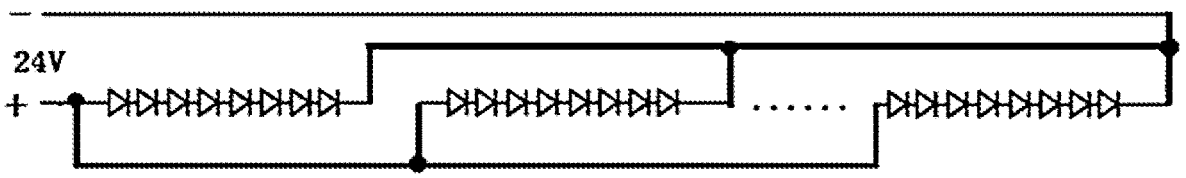
FIG. 6 is a structural schematic diagram of another connecting way of a plurality of LED bead units in the LED tube according to embodiment 2 of the present invention.

Connection inside the LED lamp tube may also be as shown in FIG. 6. A common positive power wire extending out from the positive terminal of the LED tube passes through the four LED bead units in order, and a common negative power wire extending out from the negative end of the last LED bead unit passes through the four LED bead units in a reverse order. The positive end of each LED bead unit is connected to the common positive power wire. The negative end of each LED bead unit is connected to the common negative power wire. The negative end of the last LED bead unit is connected to the negative terminal of the LED tube through an independent electric wire.

After wiring as shown in FIG. 5 or FIG. 6, for each LED bead unit, a total distance of a circuit from the positive electrode of the external constant-current switching power supply to the positive terminal of the LED tube to the positive end of the LED bead unit to the negative end then to the negative terminal of the LED tube and then back to the negative electrode of the external constant-current switching power supply is the same. Thus, voltages at two ends of each LED bead unit are the same and are both 24 V, so that each LED bead unit is ensured to have uniform brightness.

Embodiment 3

Figure 7:
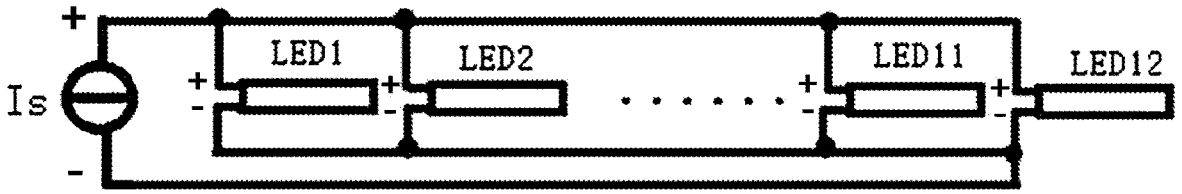
FIG. 7 is a schematic diagram of constant-current and constant-voltage connection of a garden landscape LED lighting strip produced by a plurality of LED tubes according to embodiment 3 of the present invention.

A constant-current and constant-voltage connection method of a garden landscape LED lamp lighting strip is provided. Twelve dimmable low-loss LED lamps as described in embodiment 1 or 2 are connected in parallel to form the lighting strip. A specific constant-current and constant-voltage connection method is as follows:

As shown in FIG. 7, the 24 V external constant-current switching power supply Is is arranged at a beginning end of the lighting strip; and a plurality of LED lamps are distributed in order to form the lighting strip. A positive power wire extending out from the positive electrode of the external constant-current switching power supply Is passes through the plurality of LED lamps in order, and the positive terminal of each LED tube is connected respectively to the positive power wire. The negative electrode of the external constant-current switching power supply Is is connected to the negative terminal of the last LED lamp through the negative power wire, and then a common negative wire extending out from the negative terminal of the last LED tube passes through a plurality of LED lamps in a reverse order. The negative terminal of each LED tube is connected respectively to the common negative wire. For attractiveness, the above positive power wire, negative power wire and common negative wire may respectively pass through the LED tube.

After the above connection method is used, a total distance of each circuit from the positive terminal and negative terminal of each LED lamp respectively to the positive electrode and negative electrode of the external constant-current switching power supply Is is the same. For example, as shown in FIG. 7, assuming that each lamp has a length of 1 meter and a distance of the circuit from the positive electrode of the external constant-current switching power supply Is to the positive terminal of the first lamp LED1 is 0, and the distance between two adjacent LED lamps is 0. For the second lamp, a distance of the circuit from the positive electrode of the external constant-current switching power supply Is to the positive terminal of the second lamp LED2 is 1 meter; a distance from the positive terminal of the second lamp LED2 to the negative terminal of the LED12 is 1 meter; a distance of the circuit from the negative terminal of the LED12 to the negative terminal of the twelfth LED lamp LED12 is 10 meters; and a distance of the circuit from the negative terminal of the LED12 to the negative electrode of the external constant-current switching power supply Is is 12 meters. A total distance of the circuit is 24 meters. For the eleventh lamp LED11, a distance of the circuit from the positive electrode of the external constant-current switching power supply Is to the positive terminal of the LED11 is 10 meters; a distance of the circuit from the positive terminal of the LED11 to the negative terminal is 1 meter; a distance of the circuit from the negative terminal of the LED11 to the negative terminal of LED12 is 1 meter; and a distance of the circuit from the negative terminal of the LED12 to the negative electrode of the external constant-current switching power supply Is is 12 meters. A total distance of the circuit is 24 meters. Similarly, a total distance of a circuit from the positive terminal and negative terminal of each of other LED lamps correspondingly and respectively to the positive electrode and negative electrode of the external constant-current switching power supply Is is 24 meters. Thus, not only each LED bead in each LED tube has the same voltage and each LED bead unit has the same voltage, but also voltages at two ends of each LED tube of the lighting strip are the same, so that each LED lamp has uniform brightness. By using the external constant-current switching power supply Is, the dimming of the LED lamp can be controlled by regulating the output current of the external constant-current switching power supply Is through the controller, thereby achieving more attractive effect of the lighting strip.

Embodiment 4

Figure 8:
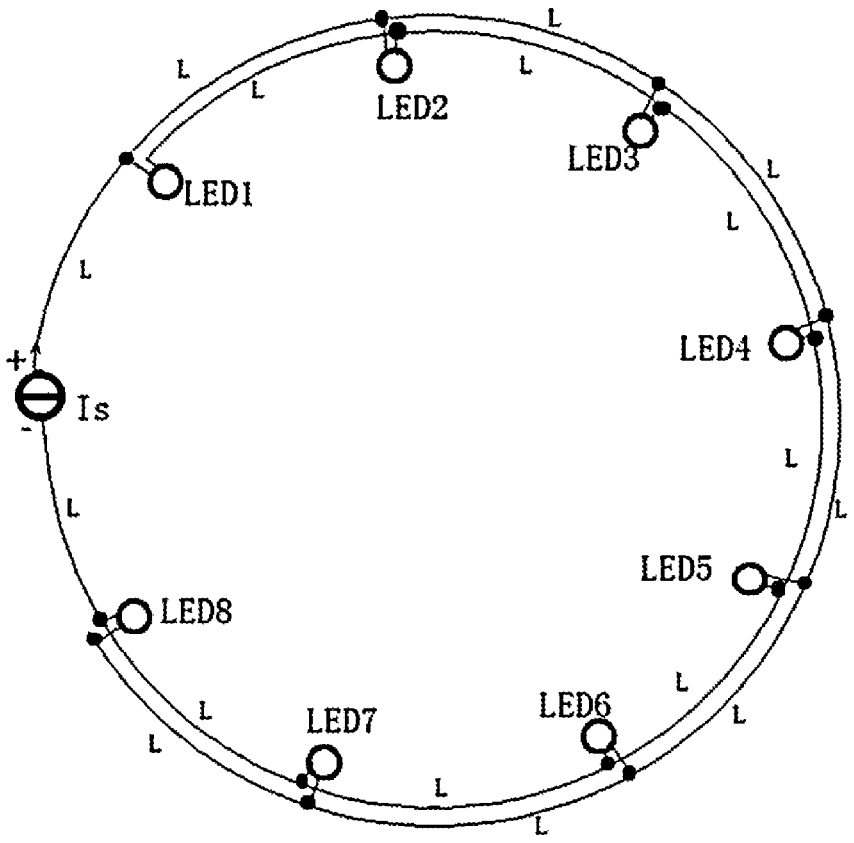
FIG. 8 is a schematic diagram of constant-current and constant-voltage connection of an indoor lamp composed by a plurality of LED lamps according to embodiment 4 of the present invention.

A constant-current and constant-voltage connection method of an indoor lamp is provided. As shown in FIG. 8, eight cylindrical LED lamps that are connected in parallel are distributed in a circular shape inside a room and powered by an external constant-current switching power supply Is. The LED lamp needs no built-in constant-current chip. It is assumed that a circuit length from the positive end of the external constant-current switching power supply Is to the positive end of the first lamp LED1 is L, and a circuit length from the negative end of the external constant-current switching power supply Is to the negative end of the eighth lamp LED8 is also L. A positive power wire extending out from the positive electrode of the external constant-current switching power supply Is passes through the eight LED lamps in order, and the positive end of each LED lamp is connected respectively to the positive power wire. A negative power wire extending out from the negative electrode of the external constant-current switching power supply Is passes through the eight LED lamps in a reverse order, and the negative end of each LED lamp is connected respectively to the negative power wire. It is assumed that a circuit length from the positive end of each LED lamp to the positive power wire is d, and a circuit length from the negative end of each LED lamp to the negative power wire is also d. A circuit length between two adjacent lamps is L. Since the lamp is a down lamp with a small diameter, the loss of a connection circuit of each LED bead in the lamp has little impact on the voltage, which can be neglected. For each lamp, a total distance of each circuit from the positive electrode and negative electrode of the external constant-current switching power supply Is respectively to the positive end and negative end of the lamp is the same and is 9L+2d respectively. For example, for the second lamp LED2, a distance of the circuit from the positive electrode of the external constant-current switching power supply Is to the positive end of the lamp is 2L; a distance of the circuit from the positive power wire to the positive end of LED2 is d; a distance of the circuit from the negative end of the LED2 to the negative power wire is d; and a distance of the circuit from a junction between the negative end of the LED2 and the negative power wire to the negative electrode of the external constant-current switching power supply Is is 7L. Therefore, a total distance of the circuit is 2L+d+d+7L, equal to 9L+2d. For the sixth lamp, a distance of the circuit from the positive electrode of the external constant-current switching power supply Is to the positive end of the lamp is 6L; a distance of the circuit from the positive power wire to the positive end of the LED6 is d; a distance of the circuit from the negative end of the LED6 to the negative power wire is d; and a distance of the circuit from a junction between the negative end of the LED6 and the negative power wire to the negative electrode of the external constant-current switching power supply Is is 3L. Therefore, a total distance of the circuit is 6L+d+d+3L, equal to 9L+2d. Similarly, a total distance of the circuit of other LED lamps is 9L+2d respectively.

The output current of the external constant-current switching power supply is controlled by the controller, so that the dimming of the LED lamp can be easy to realize. By adopting the method of the present embodiment, a plurality of LED lamps can be driven by one external constant-current switching power supply, and each LED lamp has uniform brightness and is dimmable.

By adopting the LED lamp of the present invention, other lamps such as indoor lamps and outdoor lamps can also adopt the constant-current and constant-voltage connection method of the present invention. As long as a total distance of the circuits from the positive end and negative end of each lamp respectively to the positive electrode and negative electrode of the constant-current power supply is the same, each lamp can have the same voltage, the same current and uniform brightness.

Embodiment 5

Figure 9:
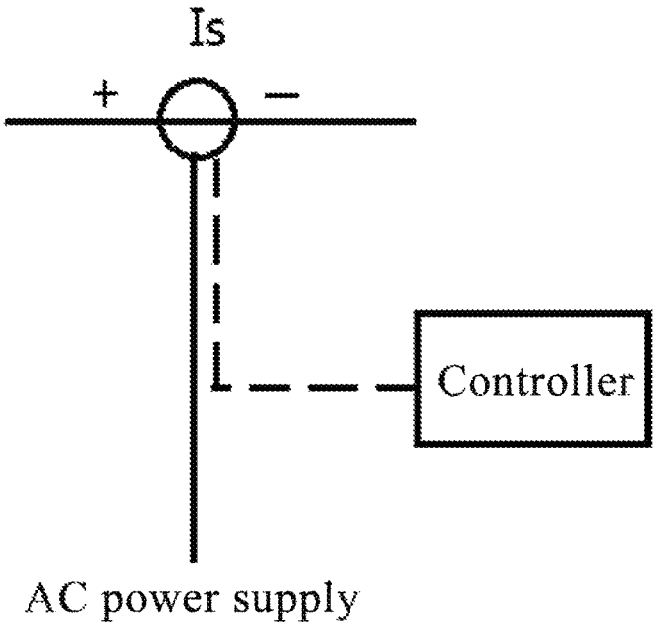
FIG. 9 is a schematic diagram of a dimming and toning control circuit according to embodiment 5 of the present invention.

As shown in FIG. 9, as a transformation of embodiment 1 to embodiment 4, a dimming controller is not used. Instead, the controller is connected to an external constant-current switching power supply Is with a corresponding communication interface through an RS485 bus or an RS232 bus or a CAN bus. The controller transmits a control signal through the bus, so that the output current of the external constant-current switching power supply Is is changed, thereby controlling the dimming and toning. Other connection methods are not changed.

What is claimed is:

1. A constant-current and constant-voltage connection method for LED lamps consisting of:

connecting the LED lamps in parallel at both ends of an external constant-current switching power supply by wires having a same wire gauge, and equating a total distance of a connection circuit of each LED lamp from a positive electrode of the external constant-current switching power supply to a positive electrode of each LED lamp and then to a negative electrode of each LED lamp and then back to a negative electrode of the external constant-current switching power supply.

2. The constant-current and constant-voltage connection method for the LED lamps according to claim 1, wherein in each LED lamp, a plurality of LED bead units are connected in parallel, and each LED bead unit is composed of a plurality of LED beads that are connected in series; and a total distance of a connection circuit of each LED bead unit from the positive electrode of each LED lamp to a positive end of the LED bead unit to a negative end of the LED bead unit and then back to the negative electrode of each LED lamp is the same.

3. The constant-current and constant-voltage connection method for the LED lamps according to claim 1, wherein the external constant-current switching power supply is connected with a controller through an RS485 bus or an RS232 bus or a CAN bus.

4. A dimmable low-loss LED lamp, consisting of:

a plurality of LED bead units that are connected in parallel;

an external constant-current switching power supply; and a controller;

wherein each LED bead unit is composed of a plurality of LED beads that are connected in series; the dimmable low-loss LED lamp is connected with the external constant-current switching power supply by wires having a same wire gauge, and the external constant-current switching power supply is connected with the controller through an RS485 bus or an RS232 bus or a CAN bus; and a total distance of a connection circuit of each LED bead unit from a positive electrode of the external constant-current switching power supply to a positive electrode of the dimmable low-loss LED lamp to a positive end of the LED bead unit to a negative end of the LED bead unit to a negative electrode of the dimmable low-loss LED lamp and then back to a negative electrode of the external constant-current switching power supply is the same.

* * * * *